US006533119B1

(12) United States Patent
Hansen et al.

(10) Patent No.: US 6,533,119 B1
(45) Date of Patent: Mar. 18, 2003

(54) BMF FACE OIL REMOVER FILM

(75) Inventors: Paul E. Hansen, St. Paul, MN (US); James S. Mrozinski, Oakdale, MN (US); Shinji Kimura, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/566,308

(22) Filed: May 8, 2000

(51) Int. Cl.[7] ..... B65D 73/00

(52) U.S. Cl. ..... 206/494; 424/402; 424/443

(58) Field of Search ..... 206/449, 494, 206/205, 233; 442/59, 402; 600/572; 424/448, 443

(56) References Cited

U.S. PATENT DOCUMENTS

| | | | | |
|---|---|---|---|---|
| 3,825,379 | A | | 7/1974 | Lohkamp et al. |
| 3,971,373 | A | | 7/1976 | Braun |
| 4,042,740 | A | | 8/1977 | Krueger |
| 4,134,948 | A | | 1/1979 | Baker, Jr. |
| 4,207,367 | A | | 6/1980 | Baker, Jr. |
| 4,215,682 | A | | 8/1980 | Kubik et al. |
| 4,279,890 | A | | 7/1981 | Harris et al. |
| 4,307,143 | A | | 12/1981 | Meitner |
| 4,328,279 | A | | 5/1982 | Meitner et al. |
| 4,426,417 | A | | 1/1984 | Meitner et al. |
| 4,429,001 | A | | 1/1984 | Kolpin et al. |
| RE31,885 | E | | 5/1985 | Meitner |
| 4,532,937 | A | | 8/1985 | Miller |
| 4,533,399 | A | | 8/1985 | Mencke |
| 4,539,256 | A | | 9/1985 | Shipman |
| 4,587,154 | A | | 5/1986 | Hotchkiss et al. |
| 4,623,576 | A | | 11/1986 | Lloyd et al. |
| 4,643,939 | A | | 2/1987 | Sugiyama et al. |
| 4,729,371 | A | | 3/1988 | Krueger et al. |
| 4,755,178 | A | | 7/1988 | Insley et al. |
| 4,818,463 | A | | 4/1989 | Buehning |
| 4,885,202 | A | | 12/1989 | Lloyd et al. |
| 4,904,174 | A | | 2/1990 | Moosmayer et al. |
| 4,906,513 | A | | 3/1990 | Kebbell et al. |
| 4,986,743 | A | | 1/1991 | Buehning |
| 5,088,502 | A | * | 2/1992 | Miller ..... 600/572 |
| 5,119,828 | A | * | 6/1992 | Miller ..... 600/573 |
| 5,744,149 | A | | 4/1998 | Girardot |
| 5,935,521 | A | * | 8/1999 | Khazaka ..... 422/61 |
| 6,214,362 | B1 | * | 4/2001 | Page ..... 424/401 |

FOREIGN PATENT DOCUMENTS

| | | |
|---|---|---|
| DE | 4209025 | 9/1993 |
| EP | 1066826 | 1/2001 |
| JP | 56-8606 | 2/1981 |
| JP | 3-286726 | 12/1991 |
| JP | H06-25277 | 4/1994 |
| JP | 6-319664 | 11/1994 |
| JP | H10-15304 | 1/1998 |
| JP | 11-290127 | 10/1999 |
| WO | WO99/29220 | 6/1999 |
| WO | WO 01/85001 | 11/2001 |

OTHER PUBLICATIONS

Van A. Wente, "Superfine Thermoplastic Fibers", *Industrial Engineering Chemistry*, vol. 48, pp. 1342 et seq. (1956).

Van A. Wente et al., "Manufacture of Superfine Organic Fibers", Report No. 4364 Naval Research Laboratories, May 25, 1954.

* cited by examiner

*Primary Examiner*—Shian Luong
(74) *Attorney, Agent, or Firm*—Gary L. Griswold; Robert W. Sprague; William J. Bond

(57) ABSTRACT

There is provided a dispensable package of oil absorbing wipes in the form of a plurality of discrete sheets comprising a consolidated melt-blown web of thermoplastic fibers. The web has an opacity value of about 65 or less when oil free, and changes transparency by at least 30 when loaded with about 6 grams or less of oil per square centimeter. The wipes are contained in a package having at least one access opening allowing a user to grasp a single discrete sheet of wipe material.

30 Claims, 3 Drawing Sheets

BMF FACE OIL REMOVER FILM

BACKGROUND AND FIELD OF THE INVENTION

This invention relates to nonwoven absorbent wiping products. The invention particularly relates to dispensable oil indicating absorbent cosmetic wiping products.

Nonwoven webs of the thermoplastic fibers have been used extensively in the past for their known ability to absorb oil or grease such as described in U.S. Pat. No. 4,307,143 (Meitner); U.S. Pat. No. 4,328,279 (Meitner et al.) and U.S. Pat. No. 4,426,417 (Meitner et al.), which patents relate to industrial oil absorbency materials. U.S. Pat. No. 4,587,154 to Hotchkiss et al. also employs a nonwoven web, made of meltblown thermoplastic fibers, for use in industrial applications. The Hotchkiss et al. patent describes point bonding the formed web to give the material integrity. The web is then sprayed with, e.g., carboxy methyl cellulose, to permit the grease or oil to be released and the web reused.

Oil absorbing nonwoven wipes for removing facial oil have also been described in the art. These wipes must be thin, conformable and non-abrasive, considerations not relevant to industrial oil absorbent materials. A significant amount of oil continuously oozes out of the face, particularly the nose, cheek, forehead and middle forehead. To maintain cleanliness and to improve the spreadability of cosmetics it is important to remove any excess oil or sebum. Soap and water work to some extent but there are always times when one is not able to wash. Dry methods of removing these facial oils include the use of thin oil absorbent wipe materials.

Conventional paper type wipes have been used to remove facial oil. For example, natural or synthetic papers using vegetable fibers, synthetic pulp or kenaf have been used. These oil absorbent papers however are generally irritating to the skin due to the hard and stiff nature of the fibers. To improve smoothness, these papers have been calendered and/or coated with powders such as calcium carbonate and sizing agents. Calendering however is not necessarily permanent and surface fibers can reform into a rough surface unless substantial amounts of binder or sizing agents are used, which decrease oil absorption. Paper wipes are also poor indicators as to their effectiveness as papers generally do not significantly change appearance when they have absorbed oil or sebum.

Improvements to oil absorbing papers are described in Japanese Kokai No. 4-45591 which teaches adhering porous spherical beads onto the surface of an oil absorbing paper so as to solve the problems caused by calendering or coating of paper, with powders such as calcium carbonate powders, and to increase the capacity of these paper to absorb sebum. Japanese Unexamined Patent Publication (Kokai) No. 6-319664 discloses a high-density oil absorbing paper produced by mixing (a) a pulp material containing vegetable fibers, as the main component with (b) an inorganic filler, followed by paper-making to form a paper with a basis weight of 0.7 (g/cm$^2$) or more. However, the oil absorbing papers disclosed in these patent publications still have a limited capacity to absorb oil or sebum and little indicating function as there is little change in opacity or color in the paper when oil is absorbed. Difficulty in confirming oil means that users of the oil clearing paper can not evaluate if or how much sebum was removed from the users' face using the oil absorbing paper such that makeup can be applied with confidence.

An oil absorbing paper for sebum is also disclosed in Japanese Examined Patent Publication (Kokoku) No. 56-8606, or U.S. Pat. No. 4,643,939, which describes a cosmetic oil absorbing paper produced by mixing hemp fibers with 10 to 70% by weight of polyolefin resin fibers and making a paper with a basis weight of from 12 to 50 (g/cm$^2$). This paper will allegedly clear upon absorption of oil but still requires conventional papermaking techniques and would be rough to the touch. Japanese Unexamined Utility Model Publication (Kokai) No. 5-18392, discloses an oil absorbing synthetic paper comprising an oil absorbing paper with a smooth surface coating of inorganic or organic powder material such as clay particles, silica fine-particles, and powdered fibers. These oil absorbing papers allegedly have some oil indicating effect by clarifying the paper upon oil absorption thus confirming oil absorption. However, the oil absorption capacity for these papers is lowered by the powder coating and it is still difficult to attain a clear change in the appearance of this type of oil clearing paper after oil absorption.

As described above, oil absorbing webs produced by using plastic fibrous material in place of cellulosic fibrous papers is known. Also, Japanese Unexamined Patent Publication (Kokai) No. 9-335451 (WO99/29220) discloses an oil sheet made of a porous plastic film. This oil absorbing sheet has absorbing higher absorption capacity than the oil absorbing papers and is also is superior in confirming removal of oil following wiping than oil absorbing papers. It is believed that the reason is that these porous plastic films exhibit low transmittance before oil absorption because of irregular reflection of light, but the transmittance increases substantially after the micro-pores of the film are filled with oils producing a large change in the film's opacity, and therefore appearance. This change in opacity clearly confirms to the user the removal of oil or sebum from his or her skin. U.S. Pat. No. 4,532,937 to Miller describes analytical film for collecting sebum as it is secreted from the sebaceous glands of a subject comprising an open-celled, micro-porous and hydrophobic polymeric film, a fibrous material having coated on one major surface a layer of synthetic, pressure-sensitive adhesive consisting essentially of high molecular weight components. The Miller patent describes its material as having pores of such a size and distribution that the film is opaque or opalescent when the pores are empty or filed with air but can become translucent or transparent upon absorption of a liquid such as sebum. However, the very small pores described for this film or material (less than 0.1 microns) do not provide a material suitable for use in cosmetic applications due to the slow oil absorption rates.

It is an object of the invention to form an oil absorbing sheet having a clear oil indicating function, such as described in WO99/29220, however in a fibrous product that is non-irritating to the skin, is easy to directly manufacture and requires no post-formation coatings or the like and can absorb oil rapidly.

The invention further relates to a method of providing an oil absorbing sheet in a dispensable form.

SUMMARY OF THE INVENTION

The present invention is directed to an oil-absorbing wipe product, which is directly formed by a melt-blown fiber forming process. The melt-blown fibrous wipe product indicates oil absorption visually to the user rapidly upon the absorption of oil by a rapid change in opacity. This synthetic fiber wipe is also non-irritating to the skin. The microfine fibers are directly formed by extruding streams of thermoplastic polymer into a hot, high-velocity attenuating airstream. The microfine fibers are then collected at a relatively low basis weight on a collecting surface as a web. This web is then subjected to a controlled calendering and converted into an oil absorbing wipe having an oil indicating function. The resulting oil absorbing wipe web generally is characterized by a basis weight of less than 40 g/M$^2$, a void volume of from about 40 to 80%, an oil absorption capacity of from 0.9 to 6 mg/cm$^2$ and a mean pore size of from 3 to 15 microns. The web is then cut or formed into discrete wipes and these wipes are suitably packaged into a dispensable package of a plurality of wipes. The wipe material has the capability to have a change in transparency after oil absorption of at least 30 (as defined herein). The wipe material is also soft, easy to handle and readily conforms to the user's face, with a Hand of less than 8 grams, but can be packaged and dispensed as would be a conventional paper tissue or wipe type product.

DETAILED DESCRIPTION

Figure 1:
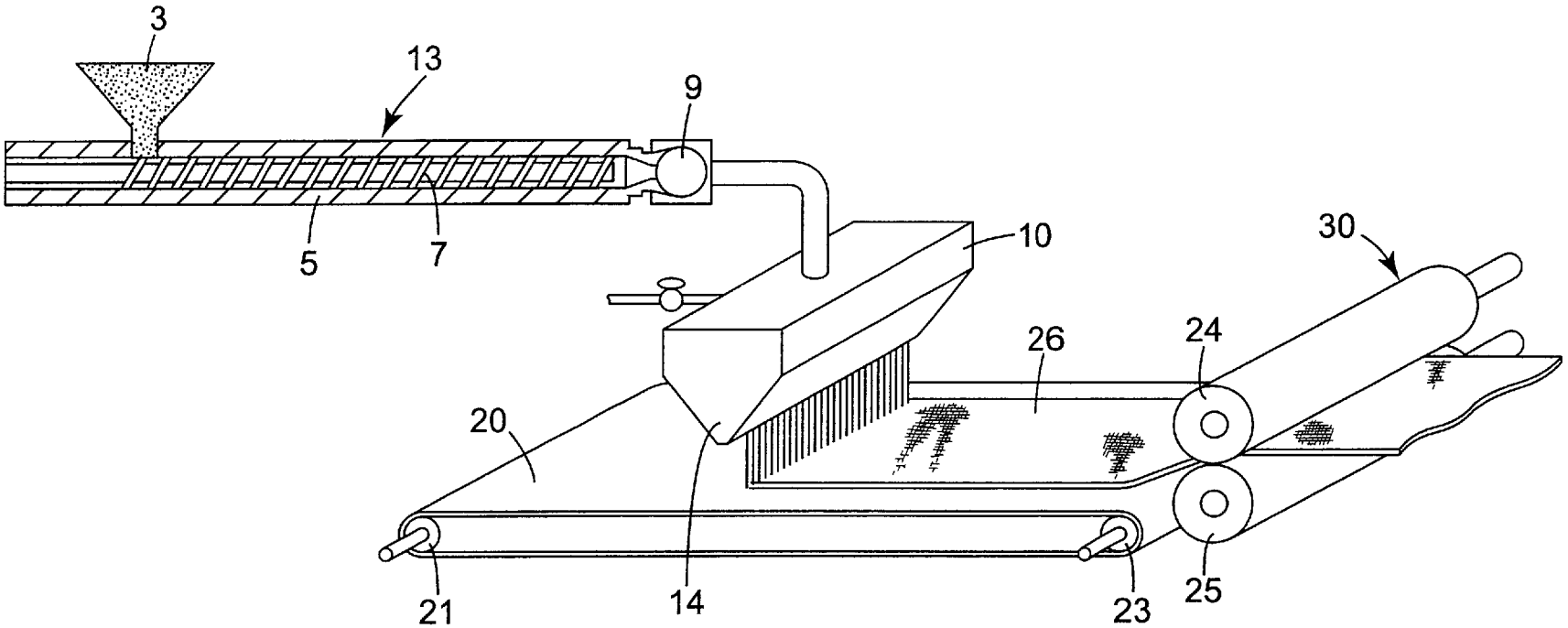
FIG. 1 is a schematic diagram of an apparatus suitable for use in forming the invention wipes.

A representative apparatus useful for preparing a web or sheet product of the invention is shown schematically in FIG. 1. Part of the apparatus for forming blown fibers is described in Wente Van A., "Superfine Thermoplastic Fibers" in *Industrial Engineering Chemistry*, Vol. 48, p. 1342 et seq. (1956), or in Report No. 4364 of the Naval Research Laboratories, published May 25, 1954, entitled "Manufacture of Superfine Organic Fibers", by Wente, V. A.; Boone, C. D.; and Fluharty, E. L. Modifications to this basic design are discussed in U.S. Pat. Nos. 4,818,463; 3,825,379; 4,907,174 and 4,986,743. This portion of the illustrated apparatus comprises a die 10, which has a set of aligned side-by-side parallel die orifices 14. The die orifices 14 open from a central die cavity. Typically, the diameter of the orifices will be on the order of from about 250 microns to about 500 microns. From about 2 to about 20 such orifices will be provided per linear centimeter of die face. Typically, the length of the orifices will be from about 1 mm to about 5 mm. The polymer is introduced to the die orifices 14 and the central die cavity from a melt extruder 13 having a resin hopper 3, a barrel 5, and a screw 7 inside the barrel 5. The molten polyolefin resin exits from the extruder barrel 5 into a gear melt pump 9 which permits improved control over the flow of the molten polymer through the downstream components of the apparatus. Upon exiting from the pump 9, the molten resin flows into a die 10 containing the die cavity through which liquefied fiber-forming material is advanced. The fiber forming thermoplastic polymer is extruded from the die orifices 14 into an attenuating airstream of heated air. This attenuating airstream is maintained at high velocities and exits from orifices or slots on either side of the set of die orifices 14. The high-velocity air is supplied to slots from two peripheral cavities. The heated air is generally about the temperature of the polymer melt or higher (e.g., 20 to 30° C. above the melt temperature).

The fibers exiting from the die orifices and attenuated by the high velocity heated air from slots are collected on collector 20, such as a belt, at a distance or from the die. The distance a is generally from 10 to 25 cm with different preferred regions for different polymers depending on the crystalline behavior of the polymer, how rapidly it is quenched to a totally non-tacky condition or other process conditions. The collector can be a flat screen, a drum, a cylinder or a finely perforated screen belt 20 as shown in FIG. 1. Cylinders 21 and 23 drive the belt 20. A gas-withdrawal device can be located behind perforated collectors to facilitate collection of the fibers, on the screen or other perforated collector surface, as a web 26. From the collector 20, the web 26 is taken to a calender 30 where the web is consolidated under pressure, preferably from 500 to 1600 Newtons per lineal centimeter. This consolidation is advantageously carried out by calendering in the nip between two generally smooth rolls 24 and 25 (e.g., they contact each other over about 90 percent of their surface area or greater, preferably 99 percent or greater), having a Shore A durometer hardness of about 50 or more, although one roll preferably has a Shore A durometer hardness of less than about 95. The consolidated web can then be collected and subsequently converted into individual wipes.

The webs are formed of fiber-forming thermoplastic materials, which materials include, for example, polyolefins, such as polyethylene, polypropylene or polybutylene; polyesters, such as polyethylene terephthalate or polybutylene terephthalate; polyurethanes or polyamides such as nylon 6 or nylon 66. The fibers formed by the melt-blown process are preferably micro fibers having an average diameter of less than 10 micrometers, preferably with an average diameter of 7 micrometers or less. Smaller average fiber diameters may be obtained with smaller diameter orifices and/or by decreasing the polymer flow rate or by increasing gas withdrawal behind the collecter.

The wipes are formed from the consolidated microfiber webs such that the wipe has a void volume of from 40 to 80 percent, preferably 45 to 75 percent and most preferably 50 to 70 percent. Where the void volume is greater than 70 percent it is difficult to obtain a rapid change in transparency or opacity as large amounts of oil are necessary to create this change, also the material becomes to compliant and difficult to handle. Where the void volume is less than 40, the material becomes too stiff and has an insufficient capacity to absorb oil. The average pore size of the wipe is generally from 3–15 microns, preferably 3 to 12 microns and most preferably 4 to 8 microns. If the pore size is less than 3 microns, it is difficult to get the rapid oil absorption rate needed for a personal use application. Void volume and pore size generally can be decreased by higher consolidation conditions and/or decreasing the average fiber diameter or the range of fiber diameters. If the pore size is greater than 15 microns the ability to retain absorbed oil is lessened as is the rapid oil indicating function. Generally the void volume, basis weight and pore size should be provided to yield an oil absorption capacity of from 0.7 to 6 mg/cm$^2$, preferably 0.8 to 5 mg/cm$^2$ and most preferably 0.9 to 4 mg/cm$^2$. If the oil absorption is less than this then the capacity to absorb facial oil is insufficient for most users and when greater than these levels then the rapid oil absorption indicating function is adversely impacted for most users.

The wipes are generally characterized by the ability to change from opaque to translucent after absorbing only a moderate amount of oil, such as would be present on a person's skin (e.g., from 0 to 8 mg/cm$^2$). The wipes are particularly useful as cosmetic wipes as after absorbing the oil at the levels excreted from common sebaceous glands, they will turn translucent, thus indicating that the undesirable oil has been removed and that makeup can be applied. The oil-indicating effect is affected by providing a wipe having an initial transparency of about 65 or less, preferably 60 or less with an ability to change transparency by about 30 or more, preferably 35 or more with a relatively low level of oil loading (e.g., 6 mg/cm$^2$). The wipe or web is generally used as a single layer material but could be laminated to other like web materials, or films or the like.

A preferred material for forming the web fibers is polypropylene wherein the desired initial and end opacity for a given wipe is controlled by the basis weight of the web forming the wipe material, the hardness of the calendering rolls, and the calendering (or consolidation) pressure and temperature. Generally, for polypropylene, a web or wipe basis weight of about 10 gm/M$^2$ to 40 gm/M$^2$ has been found suitable to provide an adequate initial transparency while allowing a change in transparency at a suitably low oil loading level with a relatively soft hand. Generally, the Hand of the wipe should be 8 grams or less, preferably 1–7 grams and most preferably 1–6 grams. For polypropylene wipes, basis weights of greater than about 40 gm/M$^2$ are too stiff to be useful as a cosmetic wipe. For other polymers or polymer blends under similar calendering conditions, different wipe basis weight ranges may be suitable depending on the oil absorbing properties and relative stiffness of the fibers forming the web.

Higher calendering temperatures and pressures have been found to have significant effects on the original transparency, pore size and void volume and also the resulting oil absorption capacity of the consolidated wipe. Higher calendering temperatures in particular significantly increase the original transparency, thus decreasing the oil-indicating value of the wipe. Under certain circumstances, it would be desirable to use chilled calendering rolls to counteract this effect. However, when a web is over-calendered (e.g., under too high a pressure and/or temperature), the web of the invention did not generally become more rigid, however, the oil indicating function and absorption capacity did decrease.

Active agents such as bactericides may be incorporated into the invention wipe by the method taught in U.S. Pat. No. 4,643,939, the substance of which is incorporated herein by reference. In this patent, conventional bactericides include phenol, p-chlormetacresol, resorcin, p-oxibenzoate, benzoic acid and its salts, salicylic acid and its salts, dihydroacetic acid an its salts, sorbic acid and its salts, boric acid, hexachlorophene, tetramethylthiuram disulfide, sulfur, carbanilide bactericides and triclosan. The bactericide can be dissolved in polar liquids such as water or alcohol and sprayed on the wipe or used as an immersion solution, preferably with 0.1 to 2% by weight of a sizing agent such as polyvinyl alcohol or starch. Such a spray treatment could also be used with film wipes such as disclosed in WO99/29220, the substance of which is incorporated herein by reference.

If the original opacity is inadequate to produce a significant enough change in opacity, opacifying agents such as silica talc, calcium carbonate or other like inorganic powders can be used at low levels. Such powders could be coated on the surface of the wipes or incorporated into the web structures. Suitable methods for incorporating opacifying agents into the web include that taught in U.S. Pat. No. 3,971,373 where a stream of particles is entrained into two separate converging melt-blown microfiber streams prior to collection. Another method of incorporating particulates is taught in U.S. Pat. No. 4,755,178 where particles are introduced in an airstream that converges into a flow of melt-blown microfibers. Preferably, only a small amount of such opacifying agents are included as they have the tendency to detract from the wipe softness.

In addition to the above, other conventional web additives such as surfactants colorants, and antistatic agents can be incorporated into the web by known methods.

Figure 2:
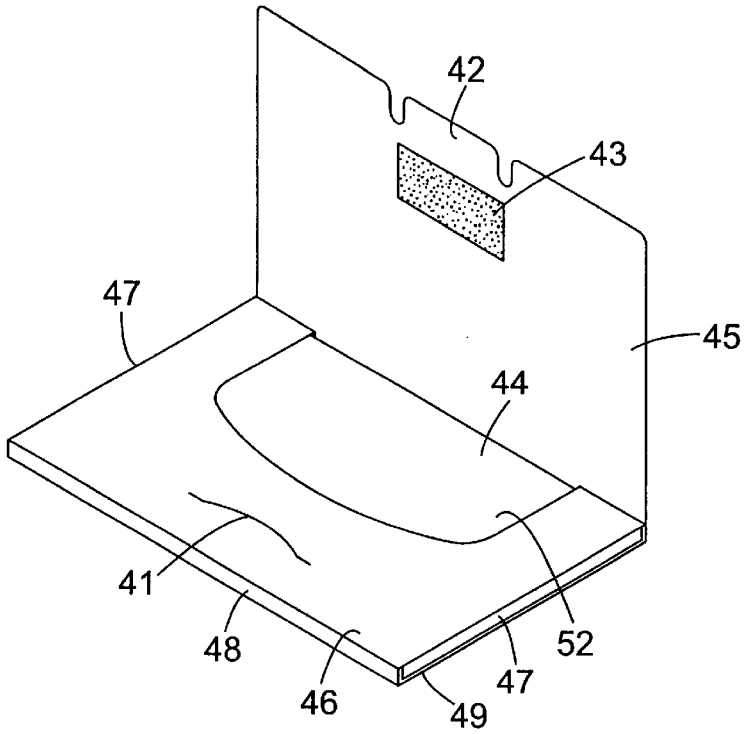
FIG. 2 is a perspective view of a dispensable package of oil absorbing wipes.

Referring to FIG. 2, a dispensable package of facial wipes in accordance with the invention comprises a dispensable package 40 including individual sheets 44 of oil absorbent wipe material. The package 44 generally comprises a top wall 46 and bottom wall 49, generally parallel to one another, and two side walls 47. A front edge 48 is provided where the back edge is formed into a flap 45, which can be folded down onto the upper face 46 of the package 40. The flap 45 can engage with the package 40 by use of an adhesive or the like, provided as is known in the art. Alternatively, a tab 42 engagable within a slot 41 can be used as a macro-mechanical type closure. Other conventional methods known in the art include the use of cohesive materials, hook and loop fasteners, living hinges, snaps and the like to keep the flap 45 in place to cover the access opening 52 to the wipes. The dispensable package 40 contains an access opening 52 which permits a user to grasp an individual wipe and withdraw it from the package 40 for use. Generally, the access opening 52 is at its largest dimension smaller than the largest length or width dimension of the dispensable oil absorbing sheet material or wipe. However, if the individual wipes are connected in a manner that they are separable from one another then the access opening should be as large or smaller than the dimension of the wipe which is pulled through the access opening.

The discrete sheet materials or wipes can be either separated from one another or separable from one or another, both are considered to be discrete sheets or wipes according to the invention. Generally, separable wipes are provided by having a frangible connection between the discrete sheets which allow the user to break and to separate the discrete sheets one from the other. Frangible connections can be created by lines of weaknesses such as perforations, score lines or by the use of additional weak adhesive-type attachment materials or by simply frictional engagement. Discrete separate wipes would require no breaking of a frangible connection. The sheets further can be stacked, provided in a roll, or folded and the like as is conventionally known for tissue-type papers. Folding is generally provided by an interleaving arrangement via v-folds, z-folds or the like. With this type of folding, opposing overlapping ends of adjacent sheets allow removal of an upper sheet to provide the lower sheet in an engagable form by frictionally pulling the lower sheet up and out through an access opening for subsequent use.

Figure 3:
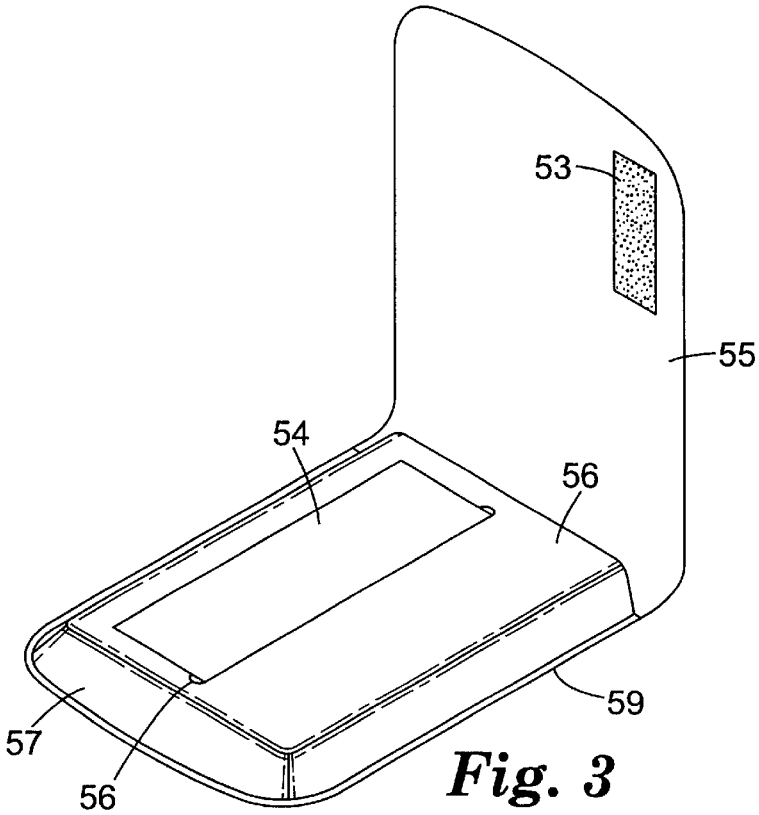
FIG. 3 is a perspective view of a dispensable package of oil absorbing wipes according to a second embodiment.

An alternative embodiment of a dispensable package arrangement is shown in FIG. 3, the top wall portion 56 is provided with an access opening slot 54 through which a sheet of oil absorbent wipe material is graspable. In this embodiment, the discrete sheets of wipe material must be interconnected so that the upper sheet can pull the lower sheet up and through the opening 56. This interconnection can be by separate sheets that are folded in an interleaving manner as described above. Alternatively the sheets could be separable sheets as described above; for example; separable sheets can be interconnected through a frangible connection. The movable flap 55 is provided on a sidewall portion and, like the flap in the FIG. 2 embodiment, can be provided with a suitable closure element 53, such as a patch of pressure-sensitive adhesive.

Figure 4:
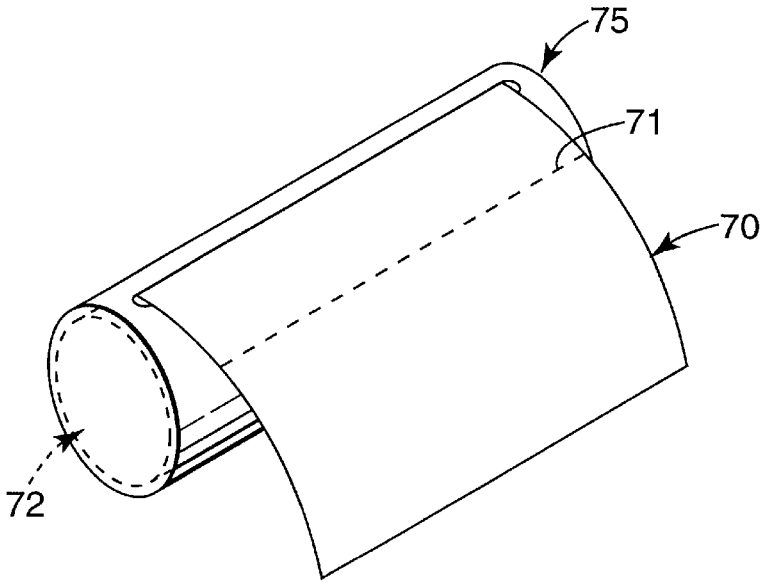
FIG. 4 is a perspective view of a dispensable package of oil absorbing wipes according to a third embodiment.

A further alternative embodiment of the dispensable oil absorbent wipe package is shown in FIG. 4 which shows a roll of discrete sheet materials 70 connected by frangible connections 71 which can be rolled into a roll form 72, with or without a core, allowing the materials to be grasped and dispensed from a roll dispenser 75.

Figure 5:
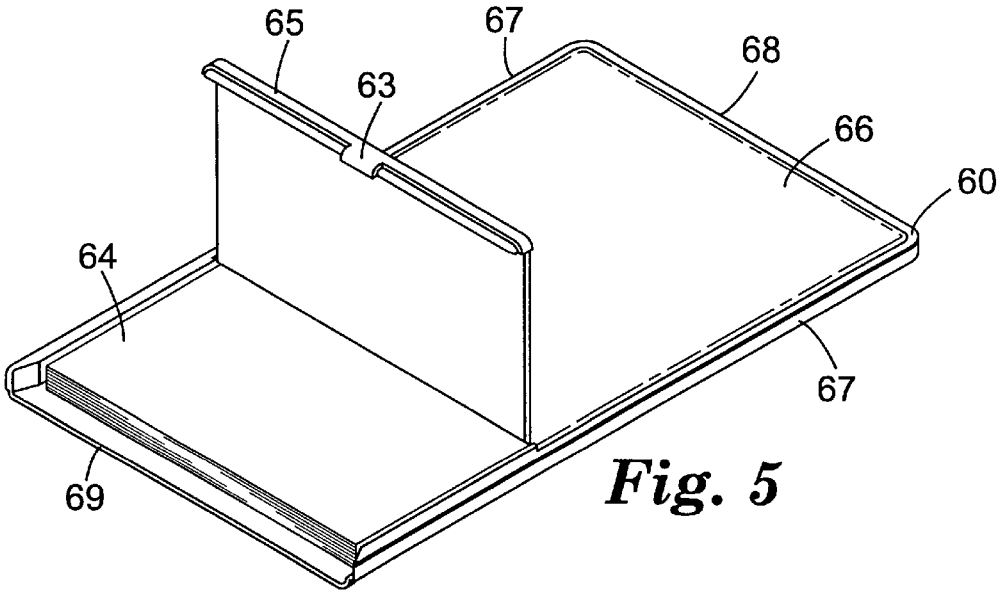
FIG. 5 is a perspective view of a dispensable package of oil absorbing wipes according to a fourth embodiment.

FIG. 5 shows an alternative embodiment of a dispensable package of the oil absorbent sheets or wipes formed with a rigid frame container 60, preferably plastic. The individual sheet materials 64 are contained within the container 60, which has a top wall 66 containing a movable flap 65, which is generally movable by a living hinge. A clasp 63 is provided on the outermost end of flap 65, which clasp 63 engages with the bottom wall 69 to provide for closure of the container 60. Side walls 67 contain the sheets 64 within the container 60 coupled with the upper walls 66 and lower wall 69. End wall 68 is preferably closed. In this embodiment, the individual sheets of discrete oil absorbent material would generally be stacked as separate sheets in an overlying stack preferably of coextensive sheets. The user would grasp an individual sheet and remove each one separately from the container using the frictional force of their fingers to separate the upper sheet from the immediate lower sheet. The individual sheets would then be used to remove skin oil by wiping over the users face. Following use, the sheet is easily compacted into a small volume shape for easy disposal.

The individual discrete sheets or wipes can be of any suitable size, however, generally for most applications the sheets would have an overall surface area of from 10 to 100 $cm^2$, preferably from 20 to 50 $cm^2$. As such, the sheets would be of a size suitable for insertion in a package, which could easily be placed in the user's purse or pocket. The material forming the dispensable containers is generally not of importance and can be formed of suitable papers, plastics, paper film laminates and the like. The shape of the tissues is generally rectangular; however, other suitable shapes such as oval, circular or the like can be used.

The following examples are provided to illustrate presently contemplated preferred embodiments and the best mode for practicing the invention, but are not intended to be limiting thereof.

Test Methods

Basis Weight

A 10 cm by 10 cm sample was die cut from the webs and weighed to the nearest 0.1 gram. Three replicates were measured and averaged and reported as grams/meter$^2$.

Caliper

The thicknesses of the finished (calendered) webs were measured in inches using a TMI direct contact gauge. 3–5 measurements were taken and averaged and reported in microns.

Gurley Porosity

The porosity of the webs was measured using a Gurley air flow test, according to ASTM D-726-58 Method A, which measures the time in seconds required to pass 100 $cm^3$ of air through 6.5 $cm^2$ (1.0 $in^2$) of web. Using a Gurley Densometer, the samples were inserted into the orifice plates and clamped. The spring catch was disengaged lowering the inner cylinder to settle under its own weight. The time for the top edge of the cylinder to reach the ZERO line was recorded which was the time it took 100 $cm^3$ of air to pass through the sample as measured in seconds. As a samples' porosity increases, the time interval decreases. 3 replicates were tested and averaged.

Pore Size

Pore size is measured in microns using a bubble point test according to ASTM F-316-80 using FLUORINERT™ solvent as a wetting fluid. This test measures the largest effective pore. 3 replicates were tested and averaged.

Void Volume

The porosity of the webs expressed as a Void Volume was calculated from the caliper and basis weight of the web and the density of polypropylene (0.91 grams/$cm^3$). Void Volume=1−[(Basis Weight/0.91)/Caliper] expressed as a percent.

Oil Absorption

The oil absorption properties of the webs were measured using the following procedure. A 100 mm by 100 mm sample was cut from the web and weighed to the nearest 0.001 gram. The sample was dipped into a pan filled with white mineral oil. The sample was removed from the pan after one minute. The excess oil on the surface of the sample was carefully wiped off using tissues. The sample was then weighed to the nearest 0.001 gram. 3 replicates were tested and averaged. The Oil Absorption Capacity was calculated 3 ways.

1. By area: $(D_1-D_0)/A$ (mg/$cm^2$)
2. By weight: $(D_1-D_0)/D_0$ (mg/mg)
3. By volume: $(D_1-D_0)/V$ (mg/$cm^3$)

where:

$D_0$=initial sample weight (mg)

$D_1$=sample weight after dipping (mg)

A=sample area ($cm^2$)

V=volume of film ($cm^3$)=(A,$cm^2$)×(film thickness,cm)

Transparency

The effect of oil absorption on the transparency of the webs was measured using a Gardner Haze Guard Plus Hazemeter following the procedure in ASTM D1003. The transparency of the webs was measured before and after the oil absorption procedure described above and is reported as percent (%). Transparency with a value of 0 representing no light transmittance. The change (delta) in transparency before and after the oil absorption procedure described above is also reported. Three replicates were tested and averaged.

Hand

The Hand, drape, or flexibility of the webs was determined using INDA Test IST 90.0–75 (R82) using a Thwing-Albert Handle-O-Meter with a 10 cm by 10 cm sample size. The machine and cross-web direction of the web was marked on each sample. Areas containing wrinkles or creases were avoided when preparing the specimens. The slot width on the Thwing-Albert Handle-O-Meter was set to 1.0 cm and a specimen was placed under the blade with the machine direction perpendicular to the slot. The direction tested was always perpendicular to the slot. The apparatus was activated causing the platform to rise and engage the specimen and forced the specimen into the slot opening. The platform motion stopped when the test cycle was completed and displayed the maximum resistance force of the blade encountered while pushing the sample through the slot. The procedure was then repeated by putting the cross-web direction perpendicular to the slot. The sample was rotated 90 degrees and both sides of the specimen were measured, thus two values were obtained for both the machine direction and the cross-web direction. The sample was then flipped over and measured again in the machine and cross directions. A total of 16 values were averaged to obtain an overall web measurement. Generally, as drape or Hand measurements decrease the sample is more conformable.

EXAMPLES 1–28

A blown microfiber web (BMF) was prepared using apparatus similar to that shown in FIG. 1 of the drawing.

Fina 3960, a 350 melt flow index polypropylene resin, was fed into the extruder 13, the temperature profile of which was gradually ramped from an initial 220° C. to 335° C. The temperature of the BMF die 10 was maintained at 371° C., the attenuating air was delivered to the die at a temperature of 390° C. and a flow rate of 5.3 cubic meters per minute. The polypropylene was delivered to the die at a rate of 0.20 kg/hr/cm. The basis weights of the webs were varied between about 10 grams/$M^2$ and 32 grams/$M^2$ and were controlled by varying the collector speed.

The BMF web was then calendered by passing the web, at 15.2 meters/minute, through a nip formed by an upper heated smooth steel roll 24 and a lower unheated 95 Shore A hard rubber roll 25. The nip pressure was varied between 525 and 1575 Newtons per lineal centimeter. The temperature of the upper steel roll was varied between 27° C. and 110° C. The caliper of the calendered webs was varied between about 25 microns to 84 microns. The specific process conditions for each of the Examples 1–28 are shown in Table 1 below. Example 3 contained 2% of a surfactant blend consisting of glycerol monolaurate (70%) and sorbitan monolaurate (30%). Example 3 was calendered by passing the web twice through the nip at 1225 Newtons per lineal centimeter.

TABLE 1

| Example | Steel Roll Temp (° C.) | Calender Nip Pressure (N/cm) | Basis Weight (grams/meter$^2$) | Caliper (microns) |
|---|---|---|---|---|
| 1 | 88 | 1050 | 14.9 | 36 |
| 2 | 88 | 1050 | 19.7 | 43 |
| 3 | 88 | 1050 | 19.5 | 43 |
| 4 | 27 | 1225 | 28.7 | 84 |
| 5 | 49 | 1225 | 29.8 | 74 |
| 6 | 60 | 1225 | 28.5 | 71 |
| 7 | 71 | 1225 | 29.1 | 71 |
| 8 | 82 | 1225 | 31.6 | 69 |
| 9 | 93 | 1225 | 30.5 | 64 |
| 10 | 27 | 1225 | 20.0 | 66 |
| 11 | 49 | 1225 | 20.5 | 56 |
| 12 | 60 | 1225 | 19.8 | 51 |
| 13 | 71 | 1225 | 19.5 | 46 |
| 14 | 82 | 1225 | 19.9 | 46 |
| 15 | 93 | 1225 | 20.0 | 46 |
| 16 | 27 | 1225 | 10.4 | 38 |
| 17 | 49 | 1225 | 10.2 | 36 |
| 18 | 60 | 1225 | 10.4 | 30 |
| 19 | 71 | 1225 | 10.3 | 30 |
| 20 | 82 | 1225 | 9.9 | 28 |
| 21 | 27 | 525 | 19.9 | 74 |
| 22 | 27 | 1050 | 20.5 | 69 |
| 23 | 27 | 1575 | 20.1 | 61 |
| 24 | 82 | 525 | 20.1 | 51 |
| 25 | 82 | 1050 | 21.3 | 48 |
| 26 | 82 | 1575 | 20.1 | 43 |
| 27 | 88 | 1225 | 21.5 | 41 |
| 28 | 88 | 1225 | 20.1 | 38 |

Comparative Examples C1–C2

BMF webs were prepared as in Examples 1–28 above using the apparatus similar to that shown in FIG. 1 except the webs were not calendered.

Comparative Examples C3–C12

BMF webs were prepared as in Examples 1–28 above using the apparatus similar to that shown in FIG. 1 except basis weight and process conditions were chosen such that the finished webs did not have the desired combination of properties.

TABLE 2

| Comparative Examples | | | | | |
|---|---|---|---|---|---|
| Comparative Example | Steel Roll Temp (° C.) | Calender Nip Pressure (N/cm) | # of Nip Passes | Basis Weight (grams/meter$^2$) | Caliper (microns) |
| C1 | — | — | 0 | 42.3 | 244 |
| C2 | — | — | 0 | 19.7 | 124 |
| C3 | 88 | 1225 | 1 | 42.5 | 81 |
| C4 | 82 | 1225 | 2 | 40.2 | 69 |
| C5 | 88 | 1225 | 2 | 40.4 | 61 |
| C6 | 100 | 1225 | 2 | 40.7 | 64 |
| C7 | 116 | 1225 | 2 | 40.7 | 56 |
| C8 | 110 | 1225 | 1 | 42.1 | 69 |
| C9 | 110 | 1225 | 2 | 42.0 | 66 |
| C10 | 110 | 1225 | 1 | 21.3 | 33 |
| C11 | 110 | 1225 | 2 | 19.9 | 28 |
| C12 | 93 | 1225 | 1 | 10.5 | 28 |

Table 3 below shows the effect of steel roll temperature at a constant nip pressure, on void volume, oil absorption and pore size at 3 different target basis weights (10, 20, 30 grams/meter$^2$) for webs of the invention. Comparative Examples C1, C2, C3 and C8 are also shown as webs outside the invention. The actual measured basis weights, which differed slightly from the targets, are given in Table 3. As the temperature of the steel roll increases at a relatively constant basis weight, the void volume of the web decreases, the size of the pores in the web decreases and the ability of the web to absorb oil decreases. As the basis weight of the webs increase at a constant steel roll temperature, the void volume of the web decreases, the size of the pores in the web decreases and the ability of the web to absorb oil decreases. This trend continues with Comparative Examples C3 and C8 showing that at even higher basis weights the ability to absorb oil is decreased even further. Webs having a basis weight greater than about 40 grams/meter$^2$ generally do not have the desired properties of the webs of this invention. More specifically, these webs do not have sufficient void volume after calendering to be effective. A void volume of greater than about 40% is generally needed to ensure that enough oil is absorbed in a reasonable time period when the web is used on the face of the user. If the webs are not calendered, as in C1 and C2, the void volume is too high. When an uncalendered web is used on the face, an insufficient amount of oil is absorbed to fill enough of the available void volume to generate an effective transparency change as shown in Table 5 below. A void volume of less than about 80% is generally needed to provide an effective transparency change. Webs having a basis weight greater than about 40 grams/meter$^2$ will generally be too stiff to be useful as shown in Table 5 below.

TABLE 3

| Example | Basis Weight (grams/meter$^2$) | Steel Roll Temp (° C.) | Void Volume (%) | Oil Absorption (mg/cm$^2$) | Pore Size (microns) |
|---|---|---|---|---|---|
| 16 | 10.4 | 27 | 70.0 | 2.24 | 11.1 |
| 17 | 10.2 | 49 | 68.5 | 1.61 | 7.4 |
| 18 | 10.4 | 60 | 62.5 | 1.32 | 6.6 |
| 19 | 10.3 | 71 | 62.9 | 1.14 | 6.6 |
| 20 | 9.9 | 82 | 61.1 | 0.97 | 5.1 |
| 10 | 20.0 | 27 | 66.7 | 4.25 | 6.64 |
| 11 | 20.5 | 49 | 59.7 | 3.28 | 6.04 |
| 12 | 19.8 | 60 | 57.2 | 2.29 | 5.11 |

TABLE 3-continued

| Example | Basis Weight (grams/meter$^2$) | Steel Roll Temp (° C.) | Void Volume (%) | Oil Absorption (mg/cm$^2$) | Pore Size (microns) |
|---|---|---|---|---|---|
| 13 | 19.5 | 71 | 53.1 | 1.78 | 5.11 |
| 14 | 19.9 | 82 | 52.2 | 1.38 | 4.15 |
| 15 | 20.0 | 93 | 51.9 | 1.02 | 4.43 |
| 4 | 28.7 | 27 | 62.4 | 5.24 | 5.53 |
| 5 | 29.8 | 49 | 55.5 | 3.73 | 4.74 |
| 6 | 28.5 | 60 | 56.0 | 3.03 | 4.43 |
| 7 | 29.1 | 71 | 55.0 | 2.59 | 4.15 |
| 8 | 31.6 | 82 | 49.4 | 2.11 | 3.69 |
| 9 | 30.5 | 93 | 47.2 | 1.68 | 3.16 |
| C1 | 42.3 | — | 80.9 | 20.1 | 9.49 |
| C2 | 19.7 | — | 82.6 | 8.88 | 11.1 |
| C3 | 42.5 | 88 | 42.5 | 2.18 | 5.11 |
| C8 | 42.1 | 110 | 32.5 | 1.40 | 2.14 |

Table 4 below shows the effect of nip pressure at two different steel roll temperatures with a target basis weight of 20 grams/meter$^2$, on void volume, oil absorption and pore size for webs of the invention. Comparative example C10 is also shown as a web outside the invention. As the calender nip pressure increases at a relatively constant basis weight and roll temperature, the void volume of the web decreases, the size of the pores in the web decreases and the ability of the web to absorb oil decreases. As the steel roll temperature increases at a constant nip pressure, the void volume of the web decreases, the size of the pores in the web decreases and the ability of the web to absorb oil decreases. This trend continues with comparative example C10 showing that at even higher roll temperatures the ability to absorb oil is decreased even further.

TABLE 4

| Example | Steel Roll Temp (° C.) | Calendar Nip Pressure (N/cm) | Void Volume (%) | Oil Absorption (mg/cm$^2$) | Pore Size (microns) |
|---|---|---|---|---|---|
| 22 | 27 | 525 | 70.3 | 4.74 | 7.4 |
| 23 | 27 | 1050 | 67.2 | 3.50 | 6.6 |
| 24 | 27 | 1575 | 63.8 | 2.87 | 6.6 |
| 25 | 82 | 525 | 56.5 | 1.59 | 5.1 |
| 26 | 82 | 1050 | 51.5 | 1.09 | 4.1 |
| 27 | 82 | 1575 | 48.8 | 0.79 | 3.5 |
| C10 | 110 | 1225 | 29.1 | 0.49 | 2.55 |

The ability of the webs of this invention to absorb sebum is important. It is also important that there be a strong visual indication to the user of the webs that sebum has been absorbed. The webs of this invention provide this indication by becoming relatively transparent after absorbing sebum. It is important that there be an indication of sebum absorption even when relatively low amounts of sebum have been absorbed. This property is quantified using the Transparency Test described above and reported in Table 5 below. The Transparency of the webs was measured before ($T_i$) and after ($T_f$) oil absorption using the Oil Absorption procedure described above. The change (delta) in Transparency ($\Delta T$) provides the indication to the user of the webs that the web has absorbed sebum. The higher the change, the greater the indication of absorption. A $\Delta T$ of greater than about 30 is generally needed to provide an effective indication to the user that sebum has been absorbed. It is important that the webs of this invention be soft to the touch, conformable to facial contours and relatively quiet when used. These attributes are quantified with the Hand test described above and shown in Table 5 below. A web having a Hand of less than about 8 grams will generally have the softness and conformability required for the webs of this invention.

TABLE 5

| Example | Transparency before ($T_i$) | Transparency after ($T_f$) | Transparency Change ($\Delta T$) | Hand (grams) |
|---|---|---|---|---|
| 16 | 60.2 | 94.4 | 34.2 | 1.2 |
| 17 | 60.2 | 94 | 33.8 | 1.4 |
| 18 | 60.5 | 94.7 | 34.2 | 0.9 |
| 19 | 64.1 | 94.6 | 30.5 | 1.9 |
| 20 | 63.7 | 94.3 | 30.6 | 0.9 |
| 10 | 38.1 | 92.1 | 54 | 3.6 |
| 11 | 41.9 | 94.6 | 52.7 | 5.4 |
| 12 | 43.5 | 94.3 | 50.8 | 2.8 |
| 13 | 47.5 | 94.1 | 46.6 | 2.6 |
| 14 | 54.8 | 94 | 39.2 | 2.6 |
| 15 | 53.2 | 94.2 | 41 | 2.5 |
| 27 | 58.2 | 94.3 | 36.1 | 1.8 |
| 28 | 59.3 | 94.3 | 35 | 1.7 |
| 4 | 29.7 | 94.6 | 64.9 | 6.4 |
| 5 | 31.1 | 94.2 | 63.1 | 5.5 |
| 6 | 39.9 | 94.3 | 54.4 | 5.0 |
| 7 | 34.6 | 94.5 | 59.9 | 4.8 |
| 8 | 40.8 | 94.5 | 53.7 | 4.4 |
| 9 | 39.2 | 94.2 | 55 | 4.8 |
| C1 | 28.0 | 85.5 | 57.5 | 18.9 |
| C2 | 36.1 | 92.4 | 56.3 | 3.8 |
| C3 | — | — | — | 14.0 |
| C4 | 44.1 | 93.8 | 49.7 | 10.5 |
| C5 | 45.1 | 93.6 | 48.5 | 12.2 |
| C6 | 44.3 | 93.4 | 49.1 | 16.1 |
| C7 | 60.2 | 93.8 | 33.6 | 15.3 |
| C8 | 42.3 | 93.6 | 51.3 | 11.8 |
| C9 | 36.2 | 93.6 | 57.4 | 13.1 |
| C10 | 60.6 | 94.2 | 33.6 | 1.8 |
| C11 | 76 | 94.3 | 18.3 | 2.4 |
| C12 | 70 | 94.7 | 24.7 | 1.1 |

We claim:

1. A dispensable package of oil absorbing wipes comprising a plurality of discrete sheets comprising a consolidated melt-blown web of thermoplastic fibers, said web having transparency value of about 65 percent or less when oil free, and which web transparency increases by at least 30 percent when loaded with about 6 grams of oil per square centimeter said wipes contained in a package having at least one access opening allowing a user to grasp a single discrete sheet of wipe material.

2. The dispensable package of oil absorbing wipes of claim 1 wherein the access opening largest dimension is less than the largest dimension of a discrete sheet of wipe material.

3. The dispensable package of oil absorbing wipes of claim 2 wherein the sheets of wipe material are separate sheets provided in a stacked relation.

4. The dispensable package of oil absorbing wipes of claim 3 wherein the sheets of wipe material are provided in an overlying stack.

5. The dispensable package of oil absorbing wipes of claim 3 wherein the sheets of wipe material are coextensive in the stack.

6. The dispensable package of oil absorbing wipes of claim 4 wherein the package has a flap which removably covers the access opening.

7. The dispensable package of oil-absorbing wipes of claim 1 wherein the thermoplastic fibers are polyolefin microfibers.

8. The dispensable package of oil-absorbing wipes of claim 1 wherein the thermoplastic fibers are polypropylene microfibers.

9. The dispensable package of oil-absorbing wipes of claim 1 wherein the thermoplastic fibers have an average diameter of about 10 micrometers or less, and the wipe has a basis weight of about 40 gm/m$^2$ or less.

10. The dispensable package of oil-absorbing wipes of claim 1 wherein the web, when it has changed transparency, has a transparency of about 90 percent or greater.

11. The dispensable package of oil-absorbing wipes of claim 1 wherein the web increases in transparency by 35 percent or more when loaded with about 6 grams of oil per square meter.

12. The dispensable package of oil-absorbing wipes of claim 1 wherein the wipes have a void volume of from 40 to 80 percent.

13. The dispensable package of oil-absorbing wipes of claim 1 wherein the wipes have a void volume of from 45 to 75 percent.

14. The dispensable package of oil-absorbing wipes of claim 1 wherein the wipes have a void volume of from 50 to 70 percent.

15. The dispensable package of oil-absorbing wipes of claim 1 wherein the average pore size of the wipe material is from 3 to 15 microns.

16. The dispensable package of oil-absorbing wipes of claim 1 wherein the average pore size of the wipe material is from 3 to 12 microns.

17. The dispensable package of oil-absorbing wipes of claim 1 wherein the average pore size of the wipe material is from 4 to 8 microns.

18. The dispensable package of oil-absorbing wipes of claim 1 wherein the wipes have an oil absorption capacity of from 0.7 to 6 mg/cm$^2$.

19. The dispensable package of oil-absorbing wipes of claim 1 wherein the wipes have an oil absorption capacity of from 0.8 to 5 mg/cm$^2$.

20. The dispensable package of oil-absorbing wipes of claim 1 wherein the wipes have an oil absorption capacity of from 0.9 to 4 mg/cm$^2$.

21. The dispensable package of oil-absorbing wipes of claim 1 wherein the wipes have a basis weight of from 10 to 40 gm/m$^2$.

22. The dispensable package of oil-absorbing wipes of claim 1 wherein the wipes have a basis weight of from 10 to 30 gm/m$^2$.

23. The dispensable package of oil-absorbing wipes of claim 1 wherein the wipes have a Hand of 8 grams or less.

24. The dispensable package of oil-absorbing wipes of claim 1 wherein the wipes have a Hand of 1 to 7 grams or less.

25. The dispensable package of oil-absorbing wipes of claim 1 wherein the wipes have a Hand of 1 to 6 grams or less.

26. The dispensable package of oil-absorbing wipes of claim 1 wherein the wipes have an active agent on at least one surface thereof.

27. The dispensable package of oil-absorbing wipes of claim 1 wherein the active agent is a bactericide.

28. An oil-absorbing porous wipe having an transparency value of about 65 percent or less when oil-free and which wipe increases in transparency by at least 30 percent when loaded with about 6 grams of oil per square centimeter which wipe has an active agent on an outer surface thereof.

29. The oil absorbing porous wipe of claim 28 wherein the active agent is a bactericide.

30. The oil absorbing porous wipe of claim 28 wherein the active agent is a salicylic acid.

* * * * *